US007118194B2

(12) United States Patent
Matsuo et al.

(10) Patent No.: US 7,118,194 B2
(45) **Date of Patent: *Oct. 10, 2006**

(54) INK CONTAINER AND RECORDING APPARATUS

(75) Inventors: Keisuke Matsuo, Kanagawa-ken (JP); Yasuo Kotaki, Kanagawa-ken (JP); Tetsuya Ohashi, Chiba-ken (JP); Noriko Sato, Tokyo (JP); Hiroki Hayashi, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/178,331

(22) Filed: Jul. 12, 2005

(65) Prior Publication Data

US 2005/0248639 A1 Nov. 10, 2005

Related U.S. Application Data

(62) Division of application No. 10/669,333, filed on Sep. 25, 2003, now Pat. No. 6,966,631.

(30) Foreign Application Priority Data

Sep. 30, 2002 (JP) ..... 2002-287550

(51) Int. Cl.
*B41J 2/14* (2006.01)

(52) U.S. Cl. ..... 347/49

(58) Field of Classification Search ..... 347/19, 347/37, 49, 85, 86, 87
See application file for complete search history.

(56) References Cited

U.S. PATENT DOCUMENTS

| | | | | |
|---|---|---|---|---|
| 5,119,115 | A | 6/1992 | Buat et al. | 347/86 |
| 5,359,357 | A | 10/1994 | Takagi et al. | 347/49 |
| 5,552,816 | A | 9/1996 | Oda et al. | 347/86 |
| 5,583,549 | A | 12/1996 | Ujita et al. | 347/86 |
| 5,619,237 | A | 4/1997 | Inoue et al. | 347/86 |
| 5,742,310 | A | 4/1998 | Kotaki | 347/86 |
| 6,050,667 | A | 4/2000 | Yamada | 347/19 |
| 6,102,533 | A | 8/2000 | Nozawa et al. | 347/86 |
| 6,137,503 | A | 10/2000 | Hashimoto et al. | 347/19 |
| 6,203,148 | B1 | 3/2001 | Kishida | 347/86 |
| 6,336,698 | B1 | 1/2002 | Imai | 347/32 |
| 6,390,601 | B1 | 5/2002 | Morita et al. | 347/49 |
| 6,431,699 | B1 | 8/2002 | Shihoh et al. | 347/86 |
| 6,450,631 | B1 | 9/2002 | Hayashi et al. | 347/86 |
| 6,464,338 | B1 | 10/2002 | Morita et al. | 347/49 |

(Continued)

FOREIGN PATENT DOCUMENTS

| | | |
|---|---|---|
| EP | 547921 | 6/1993 |

(Continued)

*Primary Examiner*—Anh T. N. Vo
(74) *Attorney, Agent, or Firm*—Fitzpatrick, Cella, Harper & Scinto

(57) ABSTRACT

An ink container detachably mountable to an ink jet recording apparatus which includes a cartridge provided with a recording head and capable of detachably carrying the ink container, and includes a mechanical switch for detecting mounting of the cartridge by its displacement, the container including a bottom side which is provided with an ink supply port for supplying the ink from an inside of the container to the recording head and which takes a bottom position in use; a substantially vertical side having an engaging portion for mounting the ink container to the cartridge; a stepped portion, in the bottom side, forming a recess having an end which is open at the vertical side; and a projected abutment portion, provided adjacent the vertical side in the recess, for displacing the mechanical switch.

4 Claims, 6 Drawing Sheets

U.S. PATENT DOCUMENTS

| | | | | |
|---|---|---|---|---|
| 6,502,917 | B1 | 1/2003 | Shinada et al. | 347/19 |
| 6,623,104 | B1 | 9/2003 | Kotaki et al. | 347/49 |
| 6,832,830 | B1 | 12/2004 | Seino et al. | 347/86 |
| 2004/0076447 | A1 | 4/2004 | Matsuo et al. | 399/110 |
| 2004/0114001 | A1 | 6/2004 | Hayashi et al. | 347/86 |

FOREIGN PATENT DOCUMENTS

| | | |
|---|---|---|
| EP | 698497 | 2/1996 |
| EP | 1013447 | 6/2000 |
| EP | 1177904 | 2/2002 |
| JP | 3-187777 | 8/1991 |
| JP | 2000-25251 | 1/2000 |
| JP | 2000-135796 | 5/2000 |
| JP | 2000-177145 | 6/2000 |
| JP | 2001-216873 | 8/2001 |
| JP | 2001-246762 | 9/2001 |
| JP | 2002-1552 | 1/2002 |
| JP | 2002-264427 | 9/2002 |

INK CONTAINER AND RECORDING APPARATUS

This application is a division of application Ser. No. 10/669,333, filed Sep. 25, 2003, now U.S. Pat. No. 6,966, 631 the contents of which is incorporated herein by reference.

FIELD OF THE INVENTION AND RELATED ART

The present invention relates to an ink jet type recording apparatus and an ink container therefor wherein ink is ejected to effect recording on a recording material, more particularly to a presence-absence detection of the ink container detachably mountable to the recording apparatus.

There are known various types of recording apparatuses for effecting printing on a sheet of paper, textile, a plastic resin material sheet, OHP sheet or the like (hereinafter simply called "recording material"), for example, a wire dot type, a thermosensitive type, a thermal transfer type, ink jet type, wherein recording heads are provided.

Among them, ink jet recording apparatus is advantageous in that running cost is low, that apparatus size is small and that color image recording is easy. Among the ink jet apparatus, a line type apparatus wherein the use is made with a line type recording head having a great number of ejection outlets are arranged in a widthwise direction of the recording paper is advantageous from the standpoint of high speed printing.

For this reason, the ink jet recording apparatus is widely used for outputting means of information processing systems such as a copying machine, a facsimile machine, an electronic typewriter, a word processor, a work station or the like (output terminal printer), and such as a personal computer, a host computer, an optical disk apparatus, a video apparatus or the like (handy or portable printer).

An ink container for supplying ink to the recording head comprises an ink absorbing material, a container for accommodating the ink absorbing material and a cap member for sealing the container.

The recording head is classified into an integral type which integrally has an ink container, and an ink container exchangeable type wherein an ink container is detachably mountable to the recording head.

Because of the recent recently in the reliability of the recording head and the demand for the low running cost, an ink jet recording apparatus using an ink container exchangeable type recording head is widely accepted. Particularly, an ink jet recording apparatus wherein a plurality of ink containers (two ink container type (black and color (cyan, magenta, yellow)), four ink container type (black, cyan, magenta and yellow) and the like are exchangeable, are widely accepted.

In such an ink container exchangeable type recording head, the positioning between the ink container and the recording head is influential to the recording quality since assured ink supply to the recording head from the ink container is necessary. It is important to provide a simple mechanism for accomplishing a high positioning accuracy with easy manipulation and without difficulty in mounting and demounting.

U.S. Pat. No. 5,619,237 discloses an ink container for a small size ink jet recording apparatus, which is detachably mountable to a holder having an ink jet recording head, the container comprising an ink supply port formed in a bottom side, a claw-like projection, provided on one end surface adjacent the bottom side, for engagement with a retention hole formed in the ink container holder, an ink supply portly y supported latch lever on the other end surface, the latch lever having a latch claw engageable with an engaging hole formed in the ink container holder. This is widely used as a structure with which the ink container can be mounted and demounted without deteriorating the positioning accuracy and with a simple manipulation.

In the case of a portable type printer, the size of the printer is required to be very small, and therefore, the ink container has to be small, too.

However, with the decrease of the size of the ink container, the inside volume of the container decreases, with the result that ink capacity decreases, and the number of prints producible per container reduces, and therefore, high exchange frequency of the ink container. In order to prevent printing defect such as fading stemming from the shortage of the remaining ink due to the small capacity of the ink container, it is desirable to detect the ink remaining amount.

There are a direct type in which the ink remaining amount is directly detected, and a dot count type in which the quantity of the used ink is counted. When the inside capacity of a small ink container is maximized to increase the usable amount of the ink, the dot count type is preferable since there is no need of providing a special mechanism inside the ink container.

In order to enhance the detection accuracy of the dot count type system, it is desirable to employ detecting means for discriminating whether the ink container is exchanged or not. As for such discrimination, there are an electrical type in which the ink container is provided with storing means which is electrically connected with the printer, and a mechanical type in which exchange of the ink container is detected by a machine switch provided in the printer.

However, when an exchangeable ink container is carried on an ink jet cartridge which is detachably mountable to the printer, it is difficult to accomplish a sufficient positional accuracy between the ink container detecting means and the ink container because of mounting errors of the respective elements.

On the other hand, in order to downsize t printer, it is desired to enhance the positional accuracy at the contact portion between the ink container detecting means and the ink container detecting means of the ink container.

SUMMARY OF THE INVENTION

Accordingly, it is a principal object of the present invention to provide an ink container which is capable of accurately displaces a mechanical ink container detecting means provided in the main assembly of a printer through a predetermined distance.

According to an aspect of the present invention, there is provided an ink container detachably mountable to an ink jet recording apparatus which includes a cartridge provided with a recording head and capable of detachably carrying the ink container, and includes a mechanical switch for detecting mounting of the cartridge by its displacement, said container comprising a bottom side which is provided with an ink supply port for supplying the ink from an inside of said container to the recording head and which takes a bottom position in use; a substantially vertical side having an engaging portion for mounting said ink container to the cartridge; a stepped portion, in said bottom side, forming a recess having an end which is open at said vertical side; and a projected abutment portion, provided adjacent said vertical side in said recess, for displacing the mechanical switch.

With this structure, when the projection is abutted to the ink container detecting means, even if the bottom side is deformed by the reaction force of the sealing member, the projection is not influenced by the reaction force since the projection is disposed adjacent t vertical wall. When the projection is disposed adjacent the engaging portion, the positional accuracy when the ink container is mounted is improved to assure the operation of the ink container detecting means. Since the projection is provided in the recess provided by the stepped portion, so that mechanical strength of the casing is enhanced adjacent the projection, and the positional accuracy when the ink container is mounted, thus assuring the operation of the ink container detecting means.

According to another aspect of the present invention, there is provided an ink container according to Claim 1, wherein said projected abutment portion has a height which is smaller than a depth of said recess from a surface of said bottom side.

This feature is effective to protect, form damage, the projection even if the ink container is inadvertently let fall upon mounting of the ink container to the cartridge, and therefore, the reliability is further improved.

According to a further aspect of the present invention, there is provided a recording apparatus comprising scanningly reciprocable holding means for holding the cartridge on which the ink container is detachably mounted, wherein the ink is ejected from the recording head mounted to the cartridge in accordance with an electric signal for ink ejection to effect recording on the recording material.

Thus, the recording apparatus using the ink container of the present invention has holding means provided with ink container detecting means for mechanically detecting mounting of the ink container. The recording apparatus of the present invention does not necessitate electrical storing means in the ink container, the inside capacity of the ink container can be made large correspondingly. In addition, the positional accuracy between the ink container detecting means and the ink container which is necessary when the recording apparatus is downsized, can be improved.

The recording apparatus of the present invention may include the ink container detecting means provided in the neighborhood of the side wall of the holding means. By disposing the ink container detecting means adjacent the side wall, it is relatively free of influence of deformation, so that positional accuracy between the ink container detecting means and the projection of the ink container can be further improved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Referring to the accompanying drawings, the description will be made as to the preferred embodiments of the present invention.

(First Embodiment)

Figure 1:
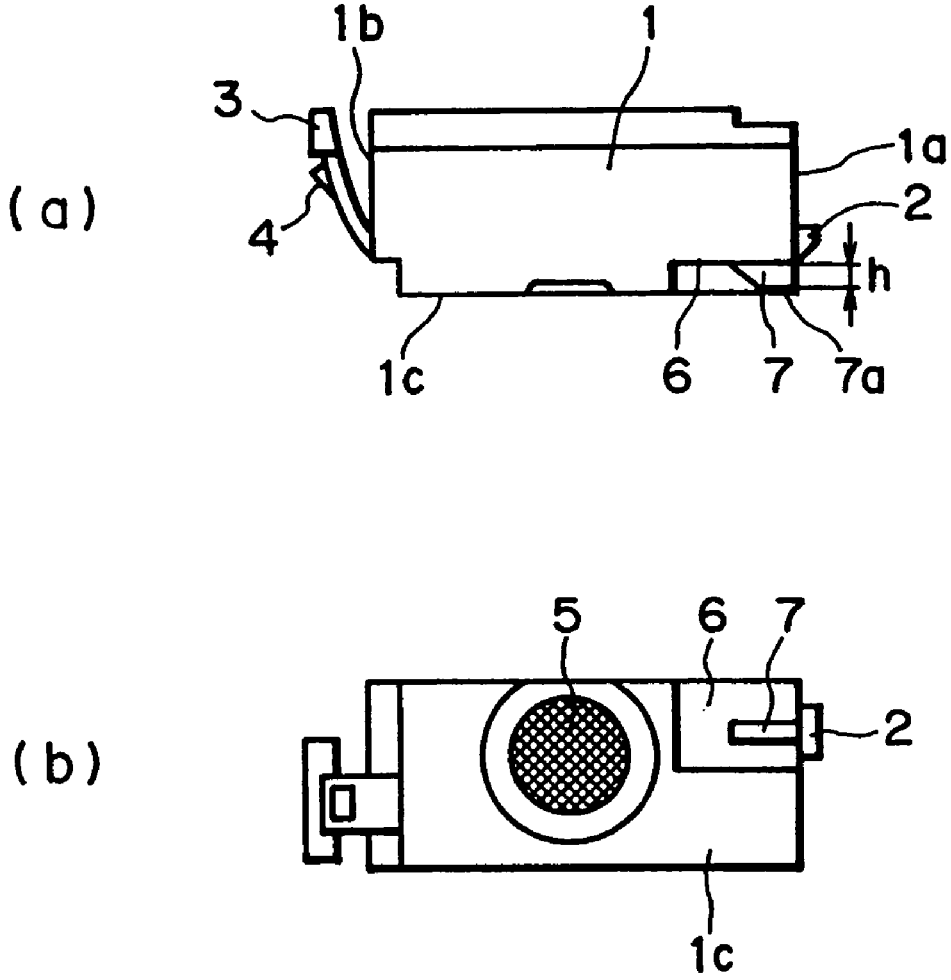
FIG. 1 is a schematic view of an ink container according to a first embodiment of the present invention.

FIG. 1 is a schematic view of an ink jet cartridge according to a first embodiment of the present invention, wherein (a) is a side view, and (b) is a bottom view.

The ink container 1 accommodating ink therein has, on a first side surface 1*a*, a retention claw 2 which is a first engaging portion engageable with a retention hole 12 formed in an ink jet cartridge 11 which will be described hereinafter, and has, on a second side surface 1*b* which is the opposite side, a latch lever 3 having a latch claw 4 which is a second engaging portion. The bottom side 1*c* of the ink container 1 is provided with an ink supply port 5 for supplying ink to the ink jet cartridge 11. The bottom side 1*c* has a step 6 of a depth h from the bottom side 1*c* to form a recess. From the bottom of the recess, a sensor pushing projection 7 is projected, and it is effective to push by an abutment surface 7*a* an ink container sensor 22 provided in a carriage 21 which will be described hereinafter. The height of the sensor pushing projection 7, that is, the length from the bottom of the recess to the abutment surface 7*a* is smaller than the depth h of the step 6. The top surface of the ink container 1 is provided with an unshown air vent for fluid communication between the ambience and the inside of the ink container 1.

The description will be made as to the manipulation of mounting the ink container 1 to the ink jet cartridge 11.

Figure 2:
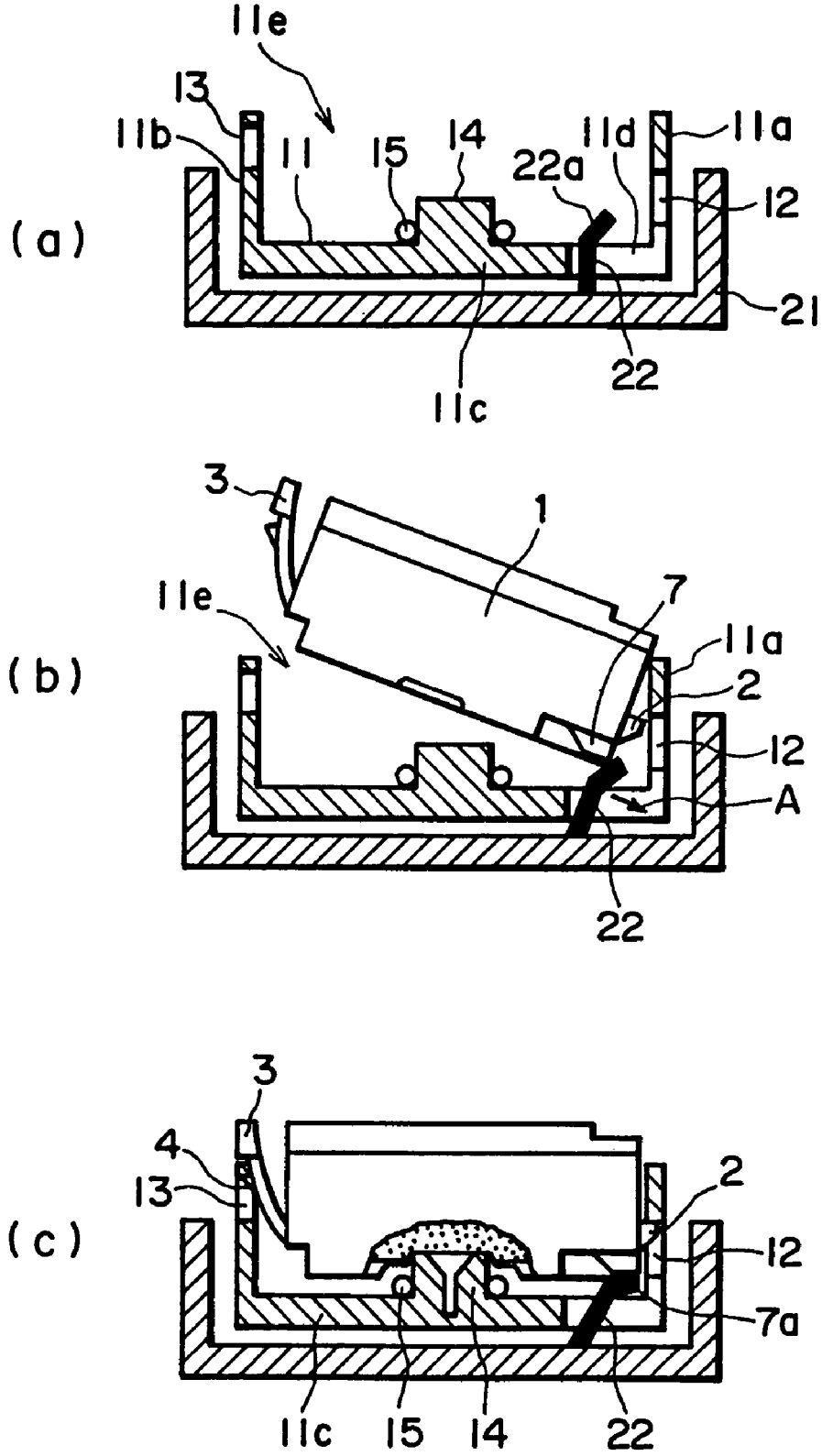
FIG. 2 is schematic view illustrating process of mounting of an ink container according to the first embodiment of the present invention.

FIG. 2 is a schematic view of a section of the ink container and ink jet cartridge illustrating the manipulation of mounting the ink container to the ink jet cartridge which is mounted on the carriage of the recording apparatus, wherein (a) shows a state in which the ink container is not mounted; (b) shows a state in which the ink container is in the process of mounting; (c) shows a state in which the mounting manipulation has been completed.

Ink jet cartridge 11 is mounted on a carriage 21 provided in an unshown recording apparatus, for reciprocation scanning. The ink jet cartridge 11 generally comprises a first cartridge side surface 11*a*, a second cartridge side surface 11*b* and a cartridge bottom side 11*c*, and in the top side, there is an opening 11*e* to permit mounting the ink container 1.

The first cartridge side surface 11*a* is provided with a retention hole 12 for engagement with the retention claw 2 of the ink container 1, and the second cartridge side surface 11*b* is provided with a retention hole 13 for engagement with the latch claw 4 of the ink container 1.

The cartridge bottom side 11*c* of the ink jet cartridge 11 is provided with a projected ink communication tube 14, to which an ink supply port 5 of the ink container 1 is abutted, so that ink is supplied from the inside of the ink container 1 to an unshown recording head through the ink communication tube 14. The recording head is provided at the cartridge bottom side 11*c* and ejects the ink in response to an electric signal supplied from the recording apparatus. Around the ink communication tube 14, a sealing member 15 such as an O ring is provided to prevent leakage of the ink. In the cartridge bottom side 11*c*, a sensor hole 11*d* is formed which permits a free end portion 22*a* of a mechanical ink container sensor 22 for detecting mounting of the ink container 1. The ink container sensor 22 provided on the carriage 21 is a tiltable type, and as will be described hereinafter, the mounting of the ink container 1 on the ink jet cartridge 11 is detected by the ink container 1 tilting the ink container sensor 22. For this reason, the sensor hole 11*d* has a sufficient size so that no interference occurs when the ink container sensor 22 tilts.

The ink container 1 is inclinedly inserted from t first side surface 1*a* side into the opening 11*e* of the ink jet cartridge 11 having such a structure, as shown in FIG. 2, (b). In more detail, firstly, the ink container 1 is placed in the opening 11*e* with such an inclination that retention claw 2 of the ink container 1 faces the first cartridge side surface 11*a* having the retention hole 12, and the retention claw 2 is brought into engagement with the retention hole 12. At this time, the sensor pushing projection 7 abuts the ink container sensor 22.

The latch lever 3 of the ink container 1 is contacted to the top end portion of the second cartridge side surface 11*b*. Then, the ink container 1 is pushed down, by which the latch lever 3 flexes, and the sensor pushing projection 7 gradually tilts the ink container sensor 22 in the direction indicated by an arrow A, until the ink container 1 is set in the ink jet cartridge 11. During the pushing of the ink container, the retention claw 2 is pressed toward the retention hole 12 by the reaction force of the latch lever 3, and therefore, the engagement between t retention claw 2 and the retention hole 12 is not unintentionally disengaged.

The ink container 1 is further pushed down, by which as shown in FIG. 2, (c), by which as shown in FIG. 2, (c), the ink supply port 5 of the ink container 1 is abutted to the ink communication tube 14 of the ink jet cartridge 11, and the latch claw 4 is engaged into the latch retention hole 13, by which the mounting of the ink container 1 into the ink jet cartridge 11 is completed. In FIG. 2, the ink container 1 is partly broken in the neighborhood of the ink supply port for better understanding of the communication between the ink supply port 5 and the ink communication tube 14. The sealing member mounted around t ink communication tube 14 is sandwiched between the bottom side 1*c* of the ink container 1 and the bottom side 11*c* of the cartridge, so that it seals t communicating portion between the ink supply port 5 and the ink communication tube 14. At this time, the portion around the ink supply port 5 in the bottom side 1*c* of the ink container 1, that is, the neighborhood of the central portion of the bottom side 1*c*, is slightly flexed by the reaction force of the sealing member 15. However, since t sensor pushing projection 7 is formed adjacent the first side surface 1*a*, it is not influenced by the flexing, thus assuredly actuating t ink container sensor 22.

The sensor pushing projection 7 of the ink container 1 in this embodiment is disposed adjacent the retention claw 2, and therefore, the positional accuracy between the ink container 1 and the ink jet cartridge 11 to permit the operation of the ink container sensor 22 with certainty.

The sensor pushing projection 7 of the sensor pushing in this embodiment, is provided in the recess formed by the step 6, and the height thereof is not more than the depth h of the step 6, the abutment surface 7*a* of the sensor pushing projection 7 is not exposed beyond t bottom side 1*c* of the ink container 1. Therefore, even if the ink container 1 is inadvertently let fall when the ink container 1 is mounted into the ink jet cartridge 11, the abutment surface 7*a* of the sensor pushing projection 7 is protected from damage, thus enhancing the reliability.

In addition, the provision of the stepped portion 6 is effective to enhance the mechanical strength of the bottom side of the ink container. Thus, deformation can be avoided against the change in the ambient conditions and mounting manipulation of the ink container into the cartridge. The provision of the sensor pushing projection 7 in the recess provided by the stepped portion 6 is effective to improve t positional accuracy, thus assuring the operation of the sensor.

(Second Embodiment)

Figure 3:
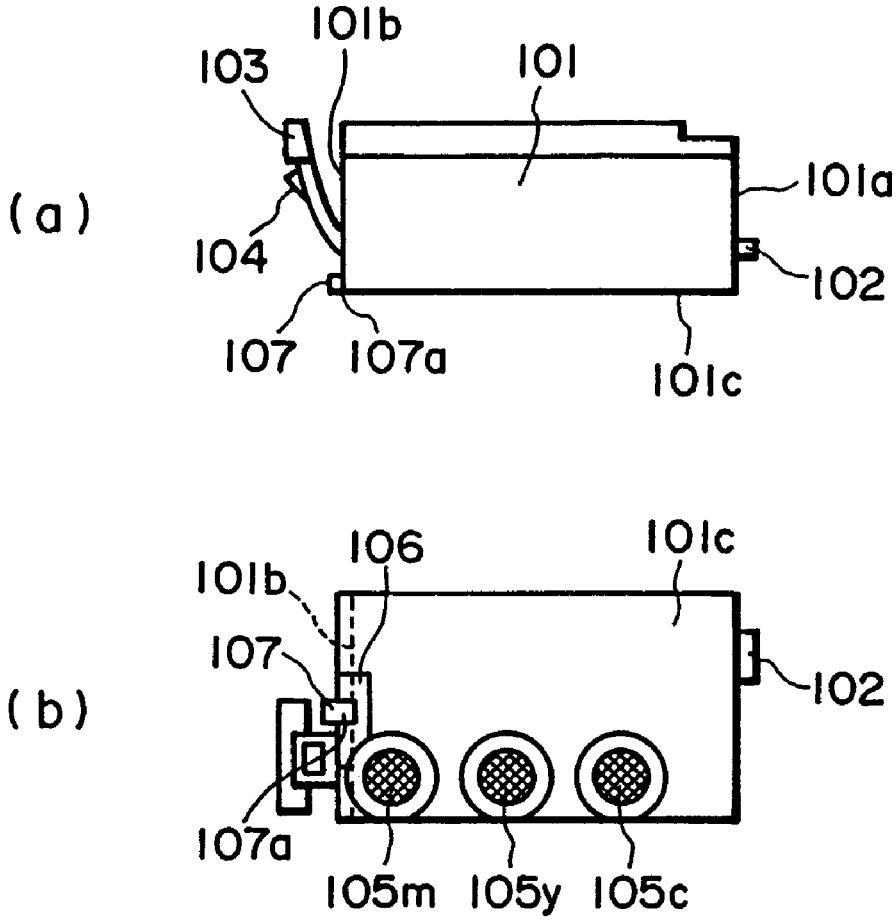
FIG. 3 is a schematic view of an ink container according to a second embodiment of the present invention.
Figure 4:
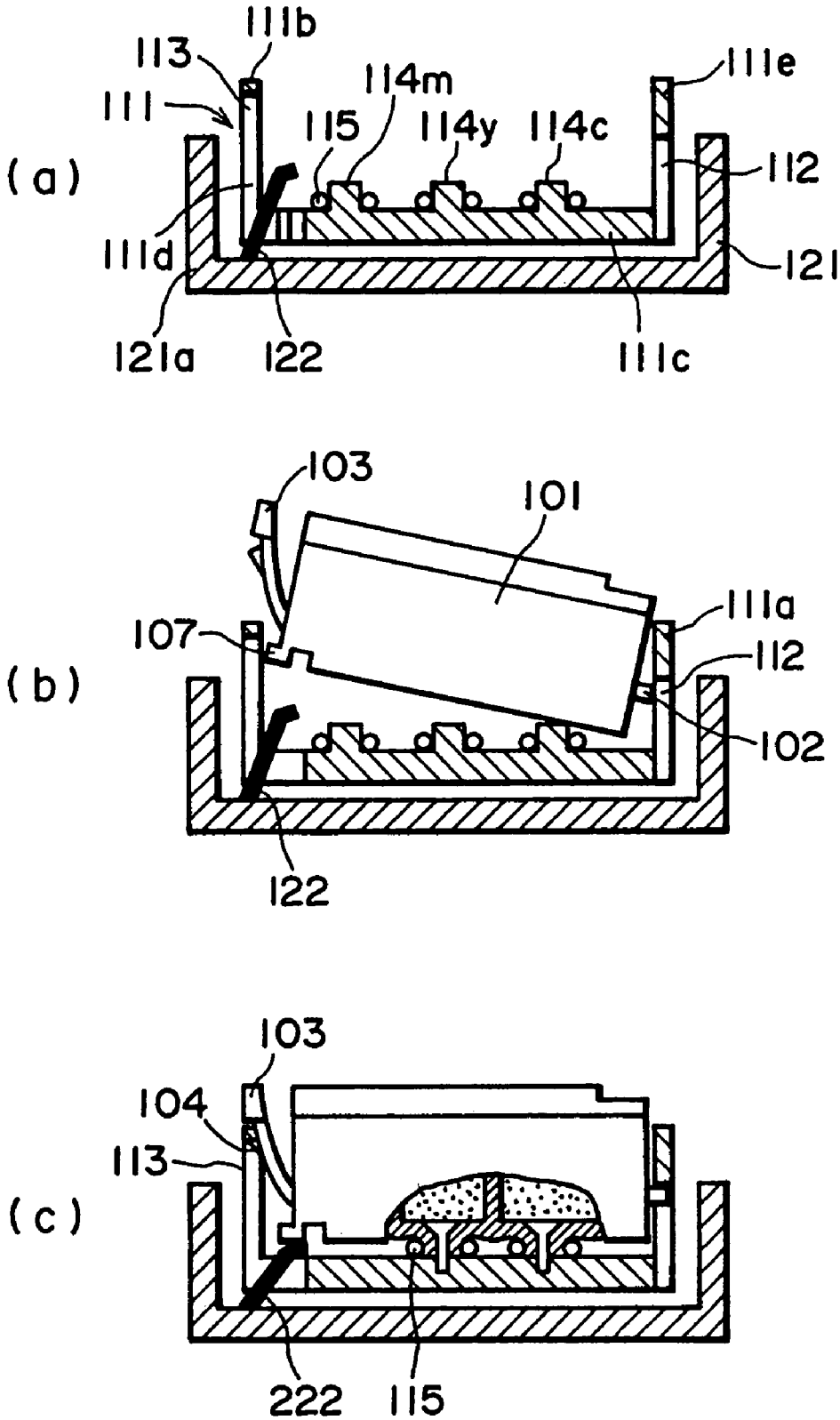
FIG. 4 is schematic view illustrating process of mounting of an ink container according to the second embodiment of the present invention.

FIG. 3 is a schematic view of an ink container according to a second embodiment of the present invention, wherein (a) is a side view, (b) is a bottom view. FIG. 4 is schematic view illustrating process of mounting of an ink container according to the second embodiment of the present invention, wherein (a) shows a state in which the ink container is not mounted; (b) shows a state in which the ink container is in the process of mounting; (c) shows a state in which the mounting manipulation has been completed.

The ink container 101 of this embodiment is the same as that of the first embodiment in the basis structure, but the inside thereof is divided into three chambers, which contain cyan, magenta, yellow inks, respectively. The chambers are provided with respective ink supply ports 105*c*, 105*m*, 105*y* in the bottom side 101*c*. In the first embodiment, the step 6 is formed in the bottom side 1*c* at the first side surface 1*a* side where the retention claw 2 is provided, and the projection 7 is provided in the recess provided by t step 6. However, in this embodiment, a step 106 is formed in a bottom side 101*c* at a second side surface 101*b* side where the latch lever 3 is provided, and a sensor pushing projection 107 is provided in the recess provided by the step 106. The sensor pushing projection 107 is not projected toward the bottom side 101*c*, but is projected in the direction perpendicular to the second side surface 101*b* direction. More particularly, an abutment surface 107*a* of the sensor pushing projection 107 which pushes the ink container sensor 122 is positioned right below the second side surface 101*b* as shown in FIG. 3, (b).

The ink jet cartridge 111 of this embodiment is also carried on a carriage 121 which is provided ro reciprocal scan in an unshown recording apparatus, and the basic structure of the ink jet cartridge 111 and the carriage 121 are similar to the ink jet cartridge 11 and the carriage 12 having been described in first embodiment. However, the cartridge bottom side 111*c* of the ink jet cartridge 111 is provided with ink communication tubes 104*c*, 104*m*, 104*y* corresponding to the ink supply ports 105*c*, 105*m*, 105*y*. In addition, the sensor hole 111*d* is formed in a second cartridge side surface 111*b*, and the ink container sensor 122 is provided on a carriage 121*a* side (second cartridge side surface 111*b* side wall of the carriage 121.

Figure 5:
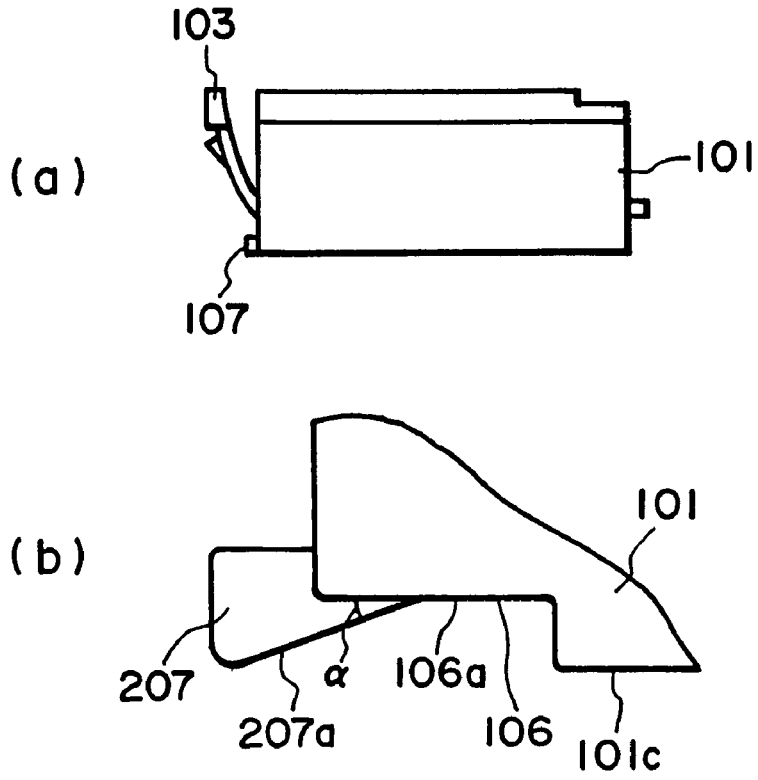
FIG. 5 is a schematic view of an ink container according to a third embodiment of the present invention.

Referring to FIG. 5, the description will be made as to the process of manipulation of mounting the ink container 101 into the ink jet cartridge 111.

Also in this embodiment, the manipulation process is generally the same as with first embodiment.

In more detail, the ink container is placed in the opening 111*e* of the ink jet cartridge 111 with such an inclination that retention claw 102 of the ink container 101 faces the first cartridge side surface 111*a* having the retention hole 112. At this time, the sensor pushing projection 107 abuts the ink container sensor 122.

The ink container 101 is pushed down, by which it is inserted into the ink jet cartridge 111 while the latch lever 103 is flexing, and while the sensor pushing projection 107 gradually tilting the ink container sensor 122. During the pushing of the ink container, the retention claw 102 is pressed toward the retention hole 112 by the reaction force of the latch lever 103, and therefore, the engagement between t retention claw 102 and the retention hole 112 is not unintentionally disengaged.

The ink container 101 is further pushed down, by which as shown in FIG. 4, (c), by which as swoon in FIG. 4, (c), the ink supply port 105 of the ink container 1 is abutted to the ink communication tube 114 of the ink jet cartridge 111, and the latch claw 104 is engaged into the latch retention hole 113, by which the mounting of the ink container 101 into the ink jet cartridge 111 is completed.

The bottom side 110*c* is slightly deformed by the bottom side 101*c* of the ink container 101 and the cartridge bottom side 11*c* sandwiches the sealing member 115. Particularly, the distance from the ink supply port 105*m* to the sensor pushing projection 107 is shorter than t distance from the ink supply port 5 to the sensor pushing projection 7 in the first embodiment, and therefore, t influence of the deformation is larger than inn the first embodiment. However, in this embodiment, the abutment surface 107*a* of the sensor pushing projection 107 in this embodiment, is disposed right below the second side surface 101*b*, so that displacement of the sensor pushing projection 107 in the direction of the reaction force of the sealing member 115 is very small. Therefore, also in this embodiment, the ink container sensor 122 can be assuredly operated without influence of the flexing of the bottom side 101*c* of the ink container 101.

Furthermore, in this embodiment, the sensor pushing projection 107 is disposed below the latch lever 103, the space below t latch lever 103 can be effectively utilized. By doing so, the inner volume of the ink container 101 is not reduced, and therefore, a large amount of the ink can be assured. In addition, the ink container sensor 122 can be disposed adjacent the carriage side surface 121*a* which is an outer wall of the carriage 121, and therefore, the assembling accuracy is improved, and the positional accuracy between the container pushing projection 107 and the ink container sensor 122 can be improved.

Figure 7:
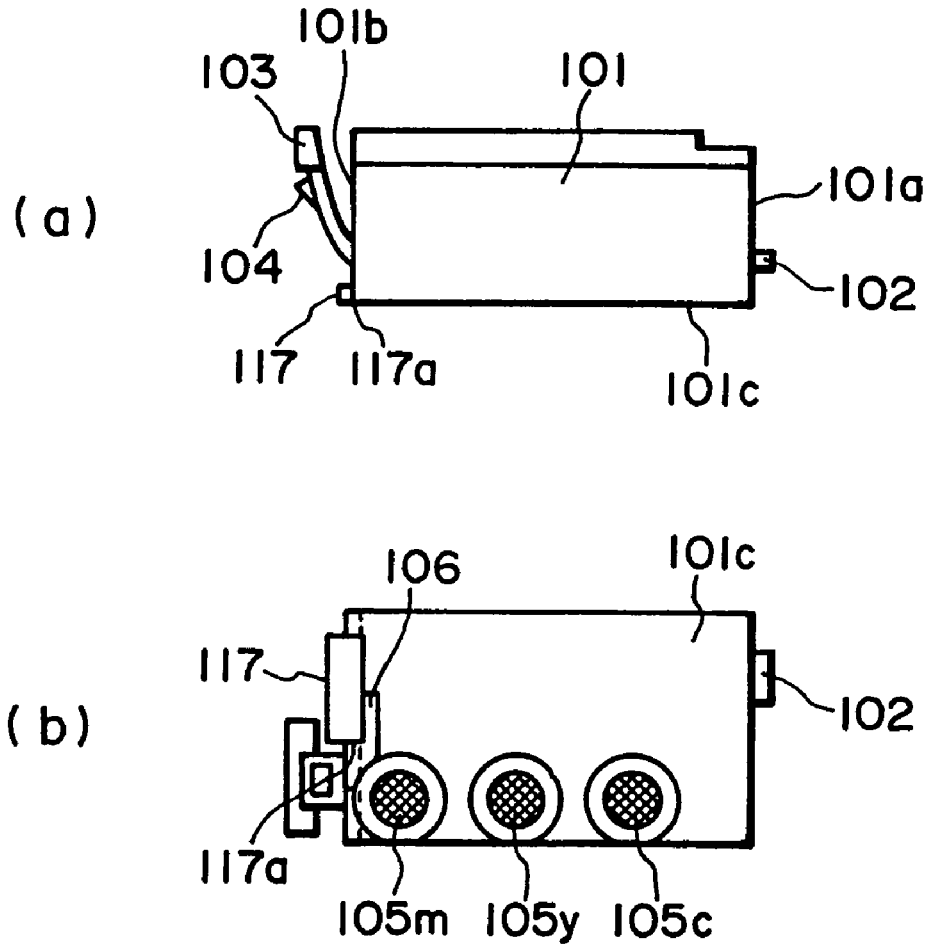
FIG. 7 is a schematic view of a container according to a modified example of the second embodiment of the present invention.

The container pushing projection, as shown in FIG. 7 by reference numeral 117, may be in the form of a rib, and the portion which is not contacted to the ink container sensor may be beyond recess provided by the stepped portion. By employing the container pushing projection 117 in the form of a rib, the mechanical strength of the container pushing projection is enhanced, and the contact surface 117*a* can assuredly operate the ink container sensor at the time of mounting the ink container.

(Third Embodiment)

FIG. 5 is a schematic view of an ink container according to a third embodiment of the present invention, wherein (a) is a side view thereof, and (b) illustrates a sensor pushing projection provided on the bottom side of the latch lever 3. The structures of this embodiment are the same as those of second embodiment except that abutment surface relative to the ink container sensor which is a bottom side of the sensor pushing projection, is inclined, and therefore, the same reference numerals as with the second embodiment are assigned to the elements having the corresponding functions, and the detailed descriptions for such elements are omitted for simplicity.

The sensor pushing projection 207 is inclined by an angle $\alpha$ relative to the step surface 106*a* of the step 106 parallel with the bottom side 101*c* of the ink container 101.

Figure 6:
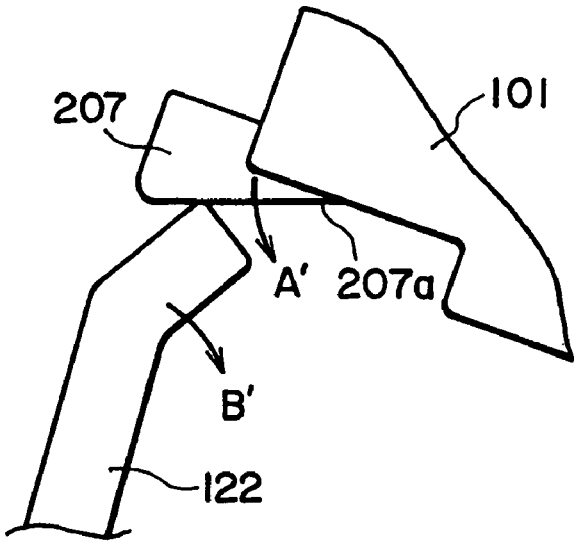
FIG. 6 is schematic view illustrating process of mounting of an ink container according to the third embodiment of the present invention.

FIG. 6 is a schematic view illustrating a state that sensor pushing projection begins to abut the ink container sensor during the process of ink container mounting, wherein arrow A shows a moving direction of the sensor pushing projection, and arrow B shows a moving direction of the ink container sensor.

Since the abutment surface 207*a* of the sensor pushing projections 207 is inclined, the sensor pushing projection 207 and the ink container sensor 122 can be moved substantially in the same direction. By doing so, the operation is assured without stress imparted to the ink container sensor 122.

While the invention has been described with reference to the structures disclosed herein, it is not confined to the details set forth and this application is intended to cover such modifications or changes as may come within the purpose of the improvements or the scope of the following claims.

What is claimed is:

1. An ink container detachably mountable to an ink jet recording apparatus which includes a cartridge provided with a recording head and capable of detachably carrying the ink container, and includes a mechanical switch for detecting mounting of said ink container by displacement thereof, said container comprising:

a bottom side which is provided with an ink supply port for supplying the ink from an inside of said container to the recording head and which takes a bottom position in use;

a substantially vertical side having an engaging portion for mounting said ink container to the cartridge or a latch lever provided with an engaging portion for mounting said ink container to the cartridge;

a stepped portion, in said bottom side, forming a recess; and a projected abutment portion, provided adjacent said vertical side in said recess, for displacing the mechanical switch.

2. A recording apparatus comprising scanningly reciprocable holding means for holding the cartridge on which the ink container according to claim 1 is detachably mountable, wherein the ink is ejected from the recording head mounted to the cartridge in accordance with an electric signal for ink ejection to effect recording on a recording material.

3. An apparatus according to claim 2, wherein said mechanical switch is disposed adjacent a substantially vertical wall of said holding means.

4. An ink container detachably mountable to an ink jet recording apparatus which includes a cartridge provided with a recording head and capable of detachably carrying the ink container, and includes a mechanical switch for detecting mounting of the ink container to said cartridge, wherein said ink container is detachably mountable to said cartridge with rotation of said ink container, said container comprising:

a bottom side which is provided with an ink supply port for supplying the ink from an inside of said container to the recording head and which takes a bottom position in use; and a substantially vertical side having a latch lever for mounting said ink container to the cartridge;

a stepped portion, in said bottom side, forming a recess;

a projected abutment portion, provided at least partly in said recess below said vertical side, for displacing the mechanical switch, wherein said abutment portion is projected beyond said vertical side.

* * * * *